US006767652B2

(12) United States Patent
Yamamoto et al.

(10) Patent No.: US 6,767,652 B2
(45) Date of Patent: Jul. 27, 2004

(54) GALVANNEALED STEEL SHEET SUPERIOR IN WORKABILITY

(75) Inventors: Takayuki Yamamoto, Kakogawa (JP); Masafumi Shimizu, Kakogawa (JP); Shunichi Hashimoto, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 113 days.

(21) Appl. No.: 10/120,372

(22) Filed: Apr. 12, 2002

(65) Prior Publication Data

US 2003/0003322 A1 Jan. 2, 2003

(30) Foreign Application Priority Data

Apr. 16, 2001 (JP) ..... 2001-117381

(51) Int. Cl.[7] ..... B32B 15/18

(52) U.S. Cl. ..... 428/659; 428/681; 428/684; 427/433; 148/533

(58) Field of Search ..... 428/655, 657, 428/659, 668, 681, 684; 148/533; 427/433

(56) References Cited

U.S. PATENT DOCUMENTS 6,342,310 B2 1/2002 Hashimoto et al.

FOREIGN PATENT DOCUMENTS

| | | |
|---|---|---|
| JP | 2-156056 | 6/1990 |
| JP | 11-131145 | 5/1999 |
| JP | 2001-3150 | 1/2001 |

*Primary Examiner*—Jennifer McNeil
(74) *Attorney, Agent, or Firm*—Oblon, Spivak, McClelland, Maier & Neustadt, P.C.

(57) ABSTRACT

A galvannealed steel sheet superior in workability wherein the steel sheet is characterized by containing silicon in an amount no less than 0.8 mass % and retained austenite in an amount no less than 3% (in terms of packing factor) and the alloy zinc plating is characterized by containing Zn—Fe alloy crystal grains which exist in its surface layer and have a specific crystal grain size such that the longer side of a crystal grain is no larger than twice the shorter side of a crystal grain and the number of crystal grains with an average particle size no smaller than 4 $\mu$m is no more than 5 per 70×50 $\mu$m.

The steel sheet with alloy zinc coating has good mechanical properties (such as total elongation) and good plating surface slidability.

7 Claims, 1 Drawing Sheet

GALVANNEALED STEEL SHEET SUPERIOR IN WORKABILITY

BACKGROUND OF THE INVENTION

1. Field of the Invention

The present invention relates to a galvannealed steel sheet superior in workability. The steel sheet excels in drawability owing to the retained austenite, and the alloy zinc plating excels in slidability. Incidentally, the term "workability" used in this specification means mechanical characteristics, such as total elongation and tensile strength, and surface slidability important for press working.

2. Description of the Related Arts

A galvannealed steel sheet is required to have both high strength and high ductility if it is to be applied to automobiles and industrial machines by press working. This requirement is becoming stringent more and more in recent years.

Conventional steel sheets designed to have both high strength and high ductility include those of ferrite-martensite dual-phase steel and ferrite-bainite dual-phase steel. (The former consists of ferrite as the base material and martensite resulting from low-temperature transformation.) Of these steel sheets, the one which contains retained austenite subject to strain induced transformation during working is particularly useful. (This steel is referred to as TRIP (TRansformation Inducing Plasticity) steel hereinafter.) With a controlled structure such that the parent phase is ferrite and the second phase is bainite (which may contain martensite), the steel sheet containing retained austenite has improved ductility owing to retained austenite and ferrite and improved strength owing to bainite (or martensite resulting from strain induced transformation).

The steel sheet containing retained austenite is obtained usually by adding a large amount of silicon to steel. Silicon effectively prevents retained austenite from decomposing to form carbide and contributes to the formation of retained austenite. On the other hand, silicon is known as an element to inhibit alloying. Therefore, silicon added in a large amount retards alloying, causes incomplete plating, and deteriorates anti-powdering properties. One effective way to accelerate alloying is to raise the alloying temperature above 800° C. or so; however, this is not desirable because retained austenite decomposes at such high temperatures.

Some ideas have been proposed to address the above-mentioned problems. For example, Japanese Patent Laid-open No. 131145/1999 discloses a high-strength high-ductility galvannealed steel sheet which contains retained austenite. According to the disclosure, it is possible to secure as much retained austenite as desired if a steel sheet is formed from a steel which has been incorporated with aluminum (which effectively forms retained austenite) in a large amount and silicon (which causes incomplete plating) in a controlled amount and which has been processed under minutely controlled conditions (for annealing, hot-dip zinc-coating, and alloying treatment). However, the present inventors' investigation revealed that the disclosed procedure improves the elongation of the parent material but decreases the slidability of the plating surface in press working.

Likewise, Japanese Patent Laid-open No. 3150/2001 discloses a TRIP steel sheet containing retained austenite. However, the disclosed steel sheet does not exhibit invariably high elongation. A probably reason for this is that the amount of retained austenite fluctuates and the characteristic properties of retained austenite (e.g., the carbon content in the retained austenite) are not fully elucidated. In addition, the steel sheet in the second disclosure mentioned above has problems with the slidability of plating surface. Thus, its overall rating for workability is poor. The alloying process in the second disclosure consists of cooling a hot-dip zinc-coated steel sheet below 300° C. at an average rate of 5–50° C./s and then reheating it up to 450–550° C. The disadvantage of this process (which does not include austemper) in inability to give retained austenite necessary for improvement in elongation. In addition, the disclosed process merely yields a galvannealed steel sheet from a low-silicon steel (containing 0.5–0.7 mass % silicon). So far, there is no process capable of yielding a steel sheet containing retained austenite from a high-silicon steel which has high elongation and improved surface slidability.

OBJECT AND SUMMARY OF THE INVENTION

The present invention was completed in view of the foregoing. It is an object of the present invention to provide a new galvannealed steel sheet which is produced from a high-silicon steel containing retained austenite. The zinc-coated steel sheet has good mechanical properties (such as total elongation) and good plating surface slidability.

The gist of the present invention reside in a galvannealed steel sheet superior in workability wherein the steel sheet is characterized by containing silicon in an amount no less than 0.8 mass % and retained austenite in an amount no less than 3% (in terms of packing factor) and the alloy zinc plating is characterized by containing Zn—Fe alloy crystal grains which exist in its surface layer and have a specific crystal grain size such that the longer side of a crystal grain is no larger than twice the shorter side of a crystal grain and the number of crystal grains with an average particle size no smaller than 4 $\mu$m is no more than 5 per 70×50 $\mu$m.

According to a preferred embodiment of the present invention, the steel may contain, in addition to silicon, the following components (in terms of mass %).

Al: 0.01–0.4%
C: 0.06–0.6%
Mn: 0.5–3%
P: no more than 0.15% (excluding 0%)
S: no more than 0.02% (excluding 0%)

According to another preferred embodiment of the present invention, the steel may additionally contain the following components (in terms of mass %).

(1) at least one species selected from:
Mo: no more than 1% (excluding 0%)
Ni: no more than 0.5% (excluding 0%)
Cu: no more than 0.5% (excluding 0%)
Cr: no more than 1% (excluding 0%)
(2) at least one species selected from:
Ti: no more than 0.1% (excluding 0%)
Nb: no more than 0.1% (excluding 0%)
V: no more than 0.1% (excluding 0%)
(3) at least one species selected from:
Ca: no more than 30 ppm (excluding 0 ppm)
REM: no more than 30 ppm (excluding 0 ppm).

The present inventors carried out investigations to solve the above-mentioned problems (such as slow alloying rate)

involved in a high-silicon steel sheet containing retained austenite. As the result, it was found that a galvannealed steel sheet has greatly improved plating surface slidability even though it is made of high-silicon steel if the alloy zinc plating is so formed as to contain a limited number of coarse crystal grains of Zn—Fe alloy in the surface layer of alloy zinc plating. The present invention is based on this finding.

DESCRIPTION OF THE PREFERRED EMBODIMENTS

Figure 1:
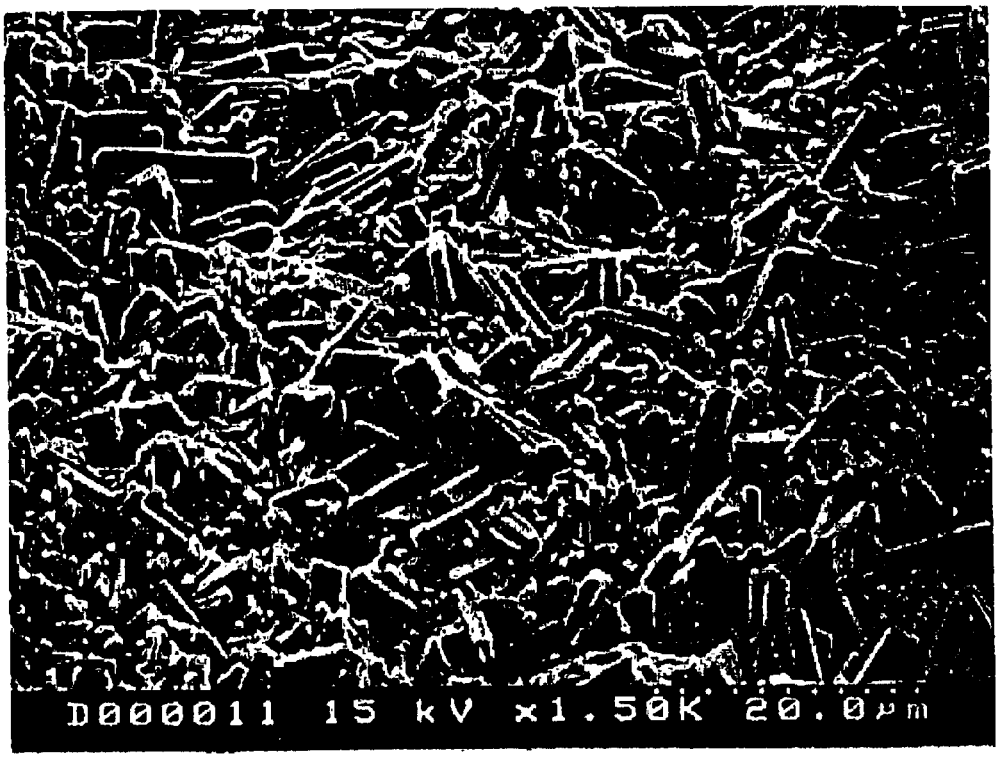
FIG. 1 is an SEM photograph showing a sample (No. 23) in Example 1.

The steel sheet of the present invention is characterized by several requirements as explained in the following.

As mentioned above, the present invention is directed to a galvannealed steel sheet superior in workability wherein the steel sheet is characterized by containing silicon in an amount no less than 0.8 mass % and retained austenite in an amount no less than 3% (in terms of packing factor) and the alloy zinc plating is characterized by containing Zn—Fe alloy crystal grains which exist in its surface layer and have a specific crystal grain size such that the longer side of a crystal grain is no larger than twice the shorter side of a crystal grain and the number of crystal grains with an average particle size no smaller than 4 $\mu$m is no more than 5 per 70×50 $\mu$m.

The steel sheet of the present invention is made of a steel containing the following specific components. (The content of each component is expressed in terms of mass %.)

Si: no less than 0.8%

Silicon effectively prevents retained austenite from decomposing to form carbide and contributes to solid-solution strengthening. It plays an important role for a steel to invariably contain retained austenite in a desired amount. For its full effect, silicon should be added in an amount no less than 0.8%, preferably 0.9%, more preferably 1.0%. The upper limit is not specifically restricted so long as the retained austenite is concerned; however, silicon in excess of 2.5% produces no additional effect but is wasted. Moreover, excess silicon would cause hot brittleness. Therefore, the upper limit should be 2.5%, preferably 2%, more preferably 1.8%, and most desirably 1.6%.

Al: 0.01–0.4%

Aluminum functions as a deoxidizing agent. In combination with silicon, it effectively prevents retained austenite from decomposing to form carbide. For its full effect, aluminum should be added in an amount no less than 0.01%. The upper limit for its deoxidizing action is 0.1%, preferably 0.07%, and more preferably 0.05%. The more the amount of aluminum, the more desirable from the standpoint of preventing decomposition of retained austenite; however, an excessively large amount of aluminum poses a problem with steel making. A recommended amount is 0.4% (preferably 0.3%).

C: 0.06–0.6%

Carbon is essential to secure high strength and as much retained austenite as necessary. To be more specific, it causes the gamma phase to contain a sufficient amount of carbon and causes the gamma phase to be retained as much as desired even at room temperature. If carbon is added in an amount no less than 0.25%, retained austenite increases and more carbon is concentrated in retained austenite, which results in a very good balance between strength and elongation. Carbon added in excess of 0.6% produces no additional effect and causes center segregation during ingoting. Carbon added in excess of 0.25% deteriorates spot-weldability. Therefore, an adequate amount of carbon should be 0.06–0.25% (preferably less than 0.2%, more preferably less than 0.15%) from the standpoint of good weldability. On the other hand, a recommended amount of carbon is 0.25–0.6% (preferably more than 0.3%) in the case where no spot-weldability is required but high elongation is required.

Mn: 0.5–3%

Manganese stabilizes the gamma phase and gives as much retained austenite as necessary. For its full effect, manganese should be added in an amount no less than 0.5%, preferably 0.9%, and more preferably 1%. However, manganese added in excess of 3% produces an adverse effect such as casting crack. An adequate amount is no more than 2.5%, preferably 2%.

P: no more than 0.15% (excluding 0%)

Phosphorus secures as much retained austenite as necessary. For its full effect, phosphorus should be added in an amount no less than 0.03%, preferably 0.05%. Phosphorus added in excess of 0.15% has an adverse effect on secondary forming. A desirable amount is no more than 0.1%.

S: no more than 0.02% (excluding 0%)

Sulfur adversely affects workability by forming sulfide inclusions (such as MnS) from which cracking start. Its content should be no more than 0.02%, preferably 0.015%.

The steel according to the present invention is composed of the above-mentioned basic components, with the remainder being substantially iron and inevitable impurities. The steel may contain additional components listed below in an amount not harmful to the effect of the present invention.

At least one species selected from Mo (no more than 1%, excluding 0%), Ni (mo more than 0.5%, excluding 0%), Cu (no more than 0.5%, excluding 0%), and Cr (no more than 1%, excluding 0%).

These elements contribute to steel strength and stabilize retained austenite and secure as much retained austenite as necessary. For their full effect without economical loss due to excess addition (Mo, Cr: 1%; Ni, Cu: 0.5%), their adequate amount is limited as follows. Mo: no less than 0.05% (preferably 0.1%) but no more than 0.8%; Ni: no less than 0.05% (preferably 0.1%) but no more than 0.4%; Cu: no less than 0.05% (preferably 0.1%) but no more than 0.4%, and Cr: no less than 0.05% (preferably 0.1%) but no more than 0.8%.

At least one species selected from Ti (no more than 0.1%, excluding 0%), Nb (mo more than 0.1%, excluding 0%), and V (no more than 0.1%, excluding 0%).

These elements cause the steel to have fine structure and high strength due to precipitation strengthening. For their full effect without economical loss due to excess addition (0.1% or more), their adequate amount is limited as follows. Ti: no less than 0.01% (preferably 0.02%) but no more than 0.08%; Nb: no less than 0.01% (preferably 0.02%) but no more than 0.08%; and V: no less than 0.01% (preferably 0.02%) but no more than 0.08%.

Ca: no more than 30 ppm and/or REM: no more than 30 ppm (excluding 0 ppm).

Calcium and REM (rare earth element) control the shape of sulfide in steel and contribute to the workability of steel. The rare earth elements used in the present invention include Sc, Y, and lanthanoid. For their full effect, they should be added in an amount no less than 3 ppm (preferably 5 ppm)

but no more than 25 ppm (because addition in excess of 30 ppm produces no additional effect but is wasted).

The steel sheet according to the present invention has the structure explained in the following.

Retained austenite: no less than 3%.

Retained austenite contributes to total elongation. For its full effect, it should be present in an amount no less than 3% (preferably 4%). The upper limit, which varies depending on the amount of carbon in the steel, should be about 20% if the carbon content is 0.06–0.25% and about 40% if the carbon content is 0.25–0.6%.

The carbon content in retained austenite, which greatly affects TRIP, particularly elongation, should be no less than 0.8%, preferably 1%, more preferably 1.2%. The more, the better; but the practical upper limit is about 1.6%.

The retained austenite should preferably be present in the form of lath. "Lath" denotes crystals having an average aspect ratio (major axis to minor axis) no smaller than 2 (preferably 4), with a desirable upper limit of 30. The retained austenite in the form of lath produces the TRIP effect like the ordinary retained austenite, and it also produces the effect of greatly improving stretch-flanging properties.

The steel sheet of the present invention is characterized by retained austenite in an amount no less than 3% (in terms of packing factor). It has additional structures as explained in the following.

Ferrite

Ferrite contributes to improvement in elongation. Ferrite in the steel of the present invention should preferably be polygonal ferrite or ferrite with a low dislocation density. For its full effect, ferrite should be present in an amount no less than 40% (preferably 50%). The upper limit, which varies depending on the amount of carbon in the steel, should be about 90% if the carbon content is 0.06–0.25% and about 80% if the carbon content is 0.25–0.6%.

Bainite

The steel should contain bainite in addition to retained austenite and ferrite mentioned above so that it contains retained austenite and carbon in an adequate amount. It may also contain martensite in an amount not harmful to the present invention. These structures contribute to improvement in strength, and they inevitably remain in the process of producing the steel according to the present invention. The content of bainite should be as small as possible.

The zinc alloy plating according to the present invention is characterized by "Zn—Fe alloy crystal grains which exist in its surface layer". This is explained in the following.

The Zn—Fe alloy crystal grains have a specific crystal grain size such that the longer side of a crystal grain is no larger than twice the shorter side of a crystal grain and the number of crystal grains with an average particle size no smaller than 4 $\mu$m is no more than 5 per 70×50 $\mu$m. (The above-defined crystal grains will be referred to as "coarse crystal grains" hereinafter.)

It has been pointed out that alloy zinc plating on a high-silicon steel sheet tends to cause troubles such as incomplete plating and poor anti-powdering properties. Anti-powdering properties relates to adhesion to the parent material. It has been found that a high-silicon steel sheet makes alloy zinc plating thereon poor in slidability (slipping characteristics). Slidability is necessary for working with dies. It has been believed that it would be very difficult to obtain a steel sheet which has good ductility due to retained austenite and yet permits alloy zinc plating thereon to have good slidability. However, the present inventors' investigation revealed that even a high-silicon steel sheet (containing 0.8% or more silicon) meets these requirements if the number of coarse crystal grains specified above is no more than five (preferably three).

It is considered that the coarse crystal grains mentioned above result from silicon oxides present in the interface between the steel sheet and the plating layer. The alloy zinc plating according to the present invention does not permit such coarse crystal grains to form but permits fine crystal grains to form uniformly instead, because it is applied onto the iron preplating (as explained later) which prevents silicon contained in the steel from concentrating in the interface and hence there is no possibility that silicon oxides occur on the surface of the iron preplating.

The average particle diameter of Zn—Fe alloy crystal grains is calculated by averaging the lengths of major and minor axes of crystal grains on the surface of alloy zinc plating which is observed in a field of view of 70×50 $\mu$m under a scanning electron microscope (×1500).

A mention is made below of the process for alloy zinc plating to be performed on the steel sheet which is characterized by high silicon content and retained austenite and a limited number of coarse crystal grains. The steel sheet is produced from a steel having the above-mentioned composition by ordinary forging and hot or cold rolling. The thus obtained steel sheet undergoes alloy zinc plating by three steps of (1) iron preplating followed by annealing, (2) hot-dip zinc-coating, and (3) alloying treatment. These steps will be explained one by one.

(1) Iron preplating

First, the steel sheet undergoes iron preplating before it is annealed. This step reduces the number of coarse Zn—Fe alloy crystal grains. In other words, it forms a layer of iron plating which prevents silicon concentration on the steel surface. The absence of silicon permits rapid alloying to take place between the steel sheet and the zinc plating layer even at a low temperature. The alloying treatment at a low temperature efficiently yields retained austenite effective for invariably high elongation and also greatly reduces the number of coarse Zn—Fe alloy crystal grains present on the surface of the alloy zinc plating layer. In addition, the preplating eliminates incomplete plating and hence contributes to a good steel sheet with plating.

Incidentally, unlike the present invention, the conventional technologies disclosed in the two laid-open Japanese Patents mentioned above do not provide fine uniform crystal grains necessary for good surface slidability because they do not involve iron pre plating important to prevent coarse crystal grains.

In addition, the first laid-open Japanese Patent mentioned above is concerned with a high-aluminum steel containing a minimum amount of silicon which involves problems with steel making. By contrast, the steel in the present invention is incorporated with aluminum to merely supplement the effect of silicon within an amount not detrimental to steel making. They differ from each other in silicon content in the steel. Likewise, the second laid-open Japanese Patent mentioned above is concerned with a low-silicon steel sheet (0.5–0.7%), whereas the present invention is directed to a high-silicon steel sheet (0.8% or more).

Incidentally, the above-mentioned iron preplating to be performed prior to hot-dip zinc-coating is not necessarily new. It has been practiced to save alloying from being inhibited by silicon added to the steel, as disclosed in Japanese Patent Laid-open No. 156056/1990. This disclosed technology is intended to form on the surface of steel sheet an iron plating layer which is immune to steel components concentrating on the steel surface, thereby promoting alloying by diffusion processing between the steel sheet and the zinc plating layer. This idea is identical with that of the present invention.

However, the disclosure mentions the promotion of alloying by preplating but does not mention or suggest the unique idea of the present invention that "preplating makes fine crystal grains in the plating surface, thereby improving the slidability of plating surface". Moreover, unlike the present invention, the disclosure mentions nothing about the steel sheet containing retained austenite and the idea of invariably forming retained austenite. In fact, the process mentioned in the disclosure does not control the rate and condition of cooling to be performed between annealing and plating. It does not give the retained austenite. The object of the disclosure is not the steel of the present invention which contains retained austenite.

The iron preplating should be carried out under the condition which satisfies the relational expression (4) below.

$$0.06 \times W \leq X \quad (4)$$

[where W denotes the coating weight ($g/m^2$) of hot-dip zinc-coating on the substrate and X denotes the coating weight ($g/m^2$) of iron plating on the substrate.]

This condition states that the coating weight (X) of iron preplating on the substrate should be equal to or more than 0.06 times the coating weight (W) of hot-dip zinc-coating on the substrate. If X is less than 0.06×W, the resulting plating causes silicon to concentrate on the steel surface as alloying proceeds. This leads to the formation of coarse Zn—Fe alloy crystal grains which have an adverse affect on the slidability of plating surface. The value of X is preferably larger than 0.08×W, more preferably larger than 0.10×W. Its upper limit is not specifically restricted from the standpoint of improving the slidability of plating surface. For adequate production cost and productivity, the upper limit should be 0.30×W, preferably 0.28×W, and more preferably 0.25×W.

The iron preplating that meets the condition specified by the relational expression (4) may be carried out in the usual way under the following condition, with a special attention paid to the duration of electrolysis which depends on the amount of plating required.

Composition of plating bath: $FeSO_4 7H_2O$ . . . 300–450 g/L)
pH of plating bath: 1.7–2.6
Temperature of plating bath: 40–70° C.
Current density: 10–250 $A/dm^2$ According to the present invention, the iron preplating is followed by hot-dip zinc-coating and subsequent alloying treatment. Therefore, the layer of iron preplating disappears from the top of the plating layer; however, it may remain in the interlayer between the steel sheet and the hot-dip zinc-coating layer so long as it does not impair the function of the present invention.

(2) Hot-dip zinc-coating

Hot-dip zinc-coating which follows the iron preplating mentioned above is preceded by annealing which is carried out to give retained austenite as desired and to control the number of coarse crystal grains.

Annealing should be carried out at an average cooling rate of 3–20° C./s from 750–850° C. to 350–460° C. Slow annealing will bring about pearlite transformation and rapid annealing will not form sufficient ferrite and will not give retained austenite as desired.

According to the present invention, the temperature (350–460° C.) at the end of annealing should be kept for 10–120 seconds for austemper treatment. The austemper treatment stably yields a large amount of retained austenite (particularly retained austenite containing more than 0.8% carbon) which produces a remarkable TRIP effect. At a lower temperature than specified above, the martensite phase remains, and at a higher temperature than specified above, the bainite phase remains in a large amount. Holding this specified temperature for 10–120 seconds permits a large amount of carbon to concentrate in the retained austenite in an extremely short time. A shorter holding time than specified above does not permit the retained austenite to be obtained as much as desired. A longer holding time than specified above promotes the formation of bainite without giving as much retained austenite as desired.

The hot-dip zinc-coating should preferably be carried out in such a way that the plating bath contains aluminum in an effective concentration of 0.08–0.12% and the plating bath is kept at 445–500° C. The procedure under this condition promotes alloying and remarkably improves anti-powdering properties.

The concentration of effective aluminum in the plating bath should be 0.08–0.12 mass %, as represented by the following expression. Incidentally, "effective aluminum" means free aluminum.

[Concentration of effective aluminum]=[Concentration of total aluminum]−[Concentration (%) of iron in plating bath]

Usually, the hot-dip zinc-coating is carried out such that the concentration of effective aluminum in the plating bath is about 0.08–0.14 mass %. However, this is not true for the present invention in which the alloying temperature is set low (as mentioned later) so as to give as much retained austenite as necessary. Alloying at a low temperature does not take place if the aluminum concentration is high. Therefore, the present invention requires that the upper limit of aluminum concentration should be 0.12 mass %, preferably 0.11 mass %, and the lower limit of aluminum concentration (necessary to improve anti-powdering properties) is 0.08 mass %, preferably 0.09 mass %.

In addition, the present invention requires that the plating bath temperature should be set at 445–500° C. This temperature, which is higher than the usual one (430–500° C.), is necessary to promote alloying and improve anti-powdering properties because the steel contains a large amount of silicon to control alloying. A desired temperature is higher than 450° C. Plating at a temperature lower than 445° C. causes a layer of pure zinc (q layer) to remain on the surface. Also, a desired temperature is lower than 490° C. Plating at a temperature higher than 500° C. leads to poor anti-powdering properties.

(3) Alloying treatment

This step is important to stabilize and secure the retained austenite formed by the above-mentioned hot-dip zinc-coating. In the present invention, this step should preferably be carried out at 400–470° C. for 5–100 seconds. This temperature is lower than the ordinary alloying temperature (which is 550–600° C.). A low alloying temperature leads to a slow alloying rate which results in low productivity. By contrast, a high alloying temperature causes retained austenite to disappear. A short alloying time leads to incomplete alloying, with pure zinc remaining on the surface. By contrast, a long alloying time leads to low productivity.

The above-mentioned three steps are recommended in the present invention. Incidentally, the annealing step that follows the iron preplating is not specifically restricted in its method. Any ordinary method may be employed. It is recommended that annealing be carried out in two phases between the $A_1$ point and the $A_3$ point.

EXAMPLES

The invention will be described in more detail with reference to the following examples, which are not intended to restrict the scope thereof. Various changes and modifications may be made in the invention without departing from the spirit and scope thereof.

Example 1

(Effect on Mechanical Properties and Plating Characteristics)

This example demonstrates how the manufacturing condition affect mechanical properties (tensile strength and elongation) and plating characteristics (incomplete plating, plating surface slidability, and anti-powdering properties).

The procedure in this example started with preparing by vacuum melting a sample steel having a composition shown in Table 1.

TABLE 1

| | (Composition of sample steel) unit: mass % | | | | | |
|---|---|---|---|---|---|---|
| Code | C | Si | Mn | P | S | Al |
| A | 0.13 | 1.3 | 1.5 | 0.008 | 0.007 | 0.04 |
| B | 0.13 | 0.5 | 1.6 | 0.008 | 0.009 | 0.03 |

The sample steel underwent hot rolling, acid pickling, and cold rolling down to 1.2 mm thick. The resulting steel sheet underwent iron preplating under the following conditions. Incidentally, duration of electrolysis for this iron preplating was varied so that the desired amount of deposit was obtained as shown in Table 2.

Composition of plating bath: $FeSO_4 7H_2O$ . . . 400 g/L
pH of plating bath: 2.0
Temperature of plating bath: 60° C.
Current density: 50 A/dm$^2$ The plated steel sheet underwent reducing annealing at 850° C. After annealing, the steel sheet was cooled at a prescribed rate and kept at a prescribed temperature for a prescribed period as shown in Table 2. The cooled steel sheet underwent hot-dip zinc-plating under the following conditions and further underwent alloying at varied temperatures.

Composition of plating bath: Zn-0.10%Al (effective aluminum concentration)

Temperature of plating bath: 460° C.

TABLE 2

| No. | Sample Steel | Coating weight of iron preplating (g/m$^2$) | Cooling rate (° C./s) | Holding temperature (° C.) | Holding time (s) | Coating weight of hot-dip zinc-coating (g/m$^2$) | Alloying temperature (° C.) | Alloying time (s) |
|---|---|---|---|---|---|---|---|---|
| 1 | A | 1.5 | 5 | 420 | 80 | 51 | 450 | 45 |
| 2 | A | 20.0 | 5 | 420 | 80 | 55 | 450 | 45 |
| 3 | A | 5.0 | 1 | 420 | 300 | 51 | 440 | 200 |
| 4 | A | 6.5 | 50 | 450 | 10 | 60 | 440 | 5 |
| 5 | A | 5.0 | 3 | 500 | 110 | 45 | 420 | 60 |
| 6 | A | 3.5 | 10 | 270 | 40 | 42 | 440 | 25 |
| 7 | A | 7.5 | 3 | 400 | 300 | 54 | 430 | 80 |
| 8 | B | 5.0 | 10 | 420 | 40 | 48 | 440 | 30 |
| 9 | A | 6.0 | 5 | 410 | 80 | 43 | 370 | 45 |
| 10 | A | 7.0 | 10 | 420 | 40 | 63 | 550 | 30 |
| 11 | A | 0 | 5 | 420 | 80 | 45 | 600 | 45 |
| 12 | A | 0 | 3 | 420 | 150 | 46 | 450 | 250 |
| 13 | A | 0.5 | 7 | 420 | 60 | 50 | 470 | 30 |
| 14 | A | 0 | 4 | 420 | 120 | 55 | 460 | 200 |
| 15 | A | 0 | 10 | 420 | 40 | 48 | 700 | 25 |
| 16 | A | 4.0 | 5 | 420 | 80 | 52 | 440 | 45 |
| 17 | A | 14.0 | 7 | 430 | 70 | 55 | 440 | 40 |
| 18 | A | 4.5 | 3 | 420 | 100 | 48 | 430 | 70 |
| 19 | A | 6.0 | 10 | 420 | 40 | 50 | 440 | 25 |
| 20 | A | 5.0 | 5 | 380 | 80 | 45 | 450 | 50 |
| 21 | A | 7.0 | 7 | 450 | 70 | 53 | 430 | 40 |
| 22 | A | 6.0 | 4 | 410 | 100 | 42 | 430 | 60 |
| 23 | A | 7.0 | 5 | 420 | 80 | 50 | 450 | 45 |
| 24 | A | 9.0 | 5 | 420 | 80 | 64 | 420 | 45 |
| 25 | A | 8.0 | 7 | 430 | 70 | 60 | 440 | 40 |

The resulting plated steel sheet was tested for the following items (1) to (7).

(1) Coating weight of hot-dip zinc-coating and concentration of iron in the coating layer The plating layer was dissolved in hydrochloric acid and then the solution was analyzed by ICP (inductively coupled plasma emission spectrometry).

(2) Measurement of coarse Zn—Fe alloy crystal grains present on the surface of alloy zinc plating The surface of alloy plating was observed under a scanning electron microscope (×1500). Zn—Fe alloy crystal grains present in a field of view of 70×50 μm were measured for long side and short side. An average of long sides and short sides was calculated. The resulting average value was regarded as the average crystal particle diameter.

(3) Measurement of retained austenite and other structures (such as ferrite, bainite, and martensite)

The amount of retained austenite and the amount of carbon in retained austenite were determined by X-ray diffractometry (5-peak method) under the following condition.

Target: Mo-Kα line
Output: 40 KV-30 mA
Filter: Zr

Scan speed: 1° per minute

The structure, such as ferrite, was observed under an optical microscope (after corrosion) and a transmission electron microscope (TEM) to determine the packing factor.

(4) Measurement of tensile strength and total elongation

Tensile tests were carried out using specimens conforming to JIS No. 5.

(5) Evaluation of incomplete plating

The number of spots without plating was counted in a unit area of 100×150 mm in the plating surface. The results were rated according to the following criteria.

◎: none

○: 1 to 3 x: 4 to 10

(6) Evaluation of the slidability of plating surface

Flat plate sliding test with a flat tool (18 mm square) was performed to measure the coefficient of friction. The results were rated according to the following criteria.

◎: lower than 0.14

○: no lower than 0.14 and lower than 0.15 x: no lower than 0.15

(7) Evaluation of anti-powdering properties

After V-bending, the inside of the bent sample was subjected to tape peeling. Peeling was visually examined and anti-powdering properties was rated according to the following criteria.

◎: Excellent in anti-powdering properties

○: Good in anti-powdering properties x: Poor in anti-powdering properties

The results are shown in Table 3.

Samples Nos. 2 and 16 to 25, which satisfy the requirements of the present invention, are very good. They have high tensile strength and elongation; they are free of incomplete plating; and they are superior in plating surface slidability and anti-powdering properties.

The following samples, which fail to meet any of the requirements of the present invention, are unsatisfactory.

Samples Nos. 1 and 13, which have an insufficient coating weight of iron preplating, are poor in slidability. They have many coarse Fe—Zn alloy crystal grains larger than 5 μm (average particle diameter).

Samples Nos. 3 and 4, which were cooled excessively slow or rapidly after annealing, are poor in elongation because of insufficient retained austenite.

Samples Nos. 5 and 6, which were held at an excessively high or low temperature for austemper treatment, are poor in elongation because of insufficient retained austenite. Sample No. 7, which was held for an excessively long time for austemper treatment, is poor in elongation because of insufficient retained austenite.

Sample No. 8, which was prepared from a sample steel (B) containing a small amount of silicon, is poor in elongation because of insufficient retained austenite.

Sample No. 9, which underwent alloying at a low temperature, contains sufficient retained austenite but is extremely poor in productivity. It is also poor in slidability due to low Fe concentration in the plating layer.

Sample No. 10, which was prepared at a high alloying temperature, is poor in elongation because of insufficient retained austenite. (Retained austenite disappeared due to the high alloying temperature.)

Samples Nos. 11, 12, 14, and 15, which did not undergo preplating, have many spots with incomplete plating and are poor in plating surface slidability because of many coarse crystal grains.

TABLE 3

| No. | Concentration of Fe in plating layer (%) | Number of coarse Fe—Zn alloy crystal grains | Retained austenite (vol %) | Carbon in retained austenite (%) | Other structure | Tensile strength (MPa) | Elongation (%) | Incomplete plating | Slidability |
|---|---|---|---|---|---|---|---|---|---|
| 1 | 8.2 | 8 | 7 | 1.3 | F + B | 631 | 37.4 | ○ | X |
| 2 | 18.7 | 0 | 6 | 1.3 | F + B | 622 | 37.5 | ◎ | ◎ |
| 3 | 10.5 | 0 | 1 | 1.0 | P + B | 597 | 28.1 | ◎ | ◎ |
| 4 | 10.7 | 0 | 2 | 1.0 | F + M | 644 | 31.1 | ◎ | ◎ |
| 5 | 10.5 | 0 | 0 | — | F + P | 603 | 26.8 | ◎ | ◎ |
| 6 | 10.3 | 2 | 1 | 1.2 | F + M | 634 | 30.7 | ○ | ○ |
| 7 | 11.5 | 0 | 2 | 1.3 | F + B | 634 | 31.4 | ◎ | ◎ |
| 8 | 11.0 | 0 | 0 | — | F + P | 592 | 28.8 | ◎ | ◎ |
| 9 | 6.5 | 0 | 8 | 1.4 | F + B | 633 | 39.2 | ◎ | X |
| 10 | 11.4 | 0 | 0 | — | F + P | 607 | 30.2 | ◎ | ◎ |
| 11 | 8.5 | 7 | 0 | — | F + P | 602 | 29.5 | X | X |
| 12 | 9.8 | 10 | 1 | 1.4 | F + B | 603 | 30.5 | X | X |
| 13 | 11.0 | 6 | 6 | 1.3 | F + B | 630 | 37.8 | ○ | X |
| 14 | 11.4 | 12 | 1 | 1.0 | F + B | 595 | 28.8 | X | X |
| 15 | 8.9 | 14 | 0 | — | F + P | 580 | 29.2 | X | X |
| 16 | 10.3 | 2 | 7 | 1.3 | F + B | 640 | 37.8 | ○ | ○ |
| 17 | 11.8 | 0 | 10 | 1.4 | F + B | 632 | 39.8 | ◎ | ◎ |
| 18 | 10.7 | 0 | 7 | 1.3 | F + B | 637 | 37.2 | ◎ | ◎ |
| 19 | 11.3 | 0 | 6 | 1.3 | F + B | 629 | 37.9 | ◎ | ◎ |
| 20 | 10.5 | 0 | 6 | 1.3 | F + B | 630 | 37.7 | ◎ | ◎ |
| 21 | 11.0 | 0 | 6 | 1.3 | F + B | 636 | 37.7 | ◎ | ◎ |
| 22 | 10.8 | 0 | 9 | 1.4 | F + B | 633 | 39.8 | ◎ | ◎ |
| 23 | 11.6 | 0 | 7 | 1.3 | F + B | 647 | 35.8 | ◎ | ○ |
| 24 | 10.0 | 0 | 10 | 1.3 | F + B | 630 | 39.5 | ◎ | ◎ |
| 25 | 11.5 | 0 | 4 | 1.4 | F + B | 637 | 34.7 | ◎ | ◎ |

Note:
F: Ferrite,
P: Pearlite,
B: Bainite,
M: Martensite

Figure 2:
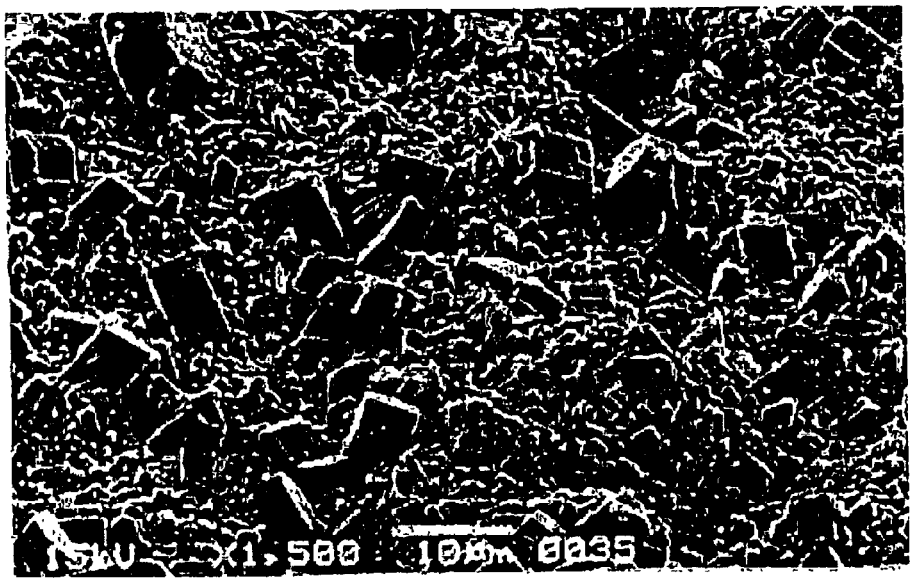
FIG. 2 is an SEM photograph showing a sample (No. 15) for comparison in Example 1.

For the purpose of reference, SEM photographs (x1500) of sample No. 23 (in Example) and sample No. 15 (in Comparative Example) are shown in FIGS. 1 and 2 respectively. It is noted that as compared with the comparative steel sheet, the steel sheet according to the present invention has much less coarse Fe—Zn alloy crystal grains (larger than 5 $\mu$m in average particle diameter) and an extremely fine plating layer.

Example 2

(Effect on Anti-Powdering Properties and Alloying)

This example demonstrates how anti-powdering properties is affected by the aluminum concentration in the plating bath and the bath temperature.

A sample steel (A) shown in Table 1 was prepared by vacuum melting. The sample steel underwent hot rolling, acid pickling, and cold rolling down to 1.2 mm thick. The resulting steel sheet underwent iron preplating under the same conditions as in Example 1 (coating weight: 5 g/m$^2$) The plated steel sheet underwent reducing annealing at 850° C. After annealing, it was cooled to 420° C. at an average cooling rate of 5° C./s and then held at 420° C. for 100 seconds. The steel sheet underwent hot-dip zinc-coating under different conditions (with the effective aluminum concentration varied in the bath and with the bath temperature varied) as shown in Table 4. The hot-dip zinc-coating was followed by alloying treatment at 430° C. for a prescribed length of time.

The plated steel sheet thus obtained was examined for anti-powdering properties and alloying state (presence or absence of pure zinc layer) in the same way as mentioned above.

The results are shown in Table 4.

TABLE 4

| No. | Effective aluminum concentration in plating bath (%) | Bath temperature (° C.) | Alloying time (s) | Anti-powdering properties | State of alloying (presence or absence of pure zinc layer) |
|---|---|---|---|---|---|
| 1 | 0.15 | 450 | 100 | ◎ | Presence |
| 2 | 0.15 | 480 | 80 | ◎ | Presence |
| 3 | 0.10 | 430 | 15 | ◎ | Presence |
| 4 | 0.10 | 440 | 30 | ◎ | Presence |
| 5 | 0.06 | 460 | 50 | x | Absence |
| 6 | 0.06 | 480 | 50 | x | Absence |
| 7 | 0.11 | 510 | 30 | x | Absence |
| 8 | 0.10 | 460 | 2 | ◎ | Presence |
| 9 | 0.09 | 455 | 1 | ◎ | Presence |
| 10 | 0.12 | 460 | 120 | ◎ | Absence |
| 11 | 0.08 | 450 | 45 | ◎ | Absence |
| 12 | 0.09 | 470 | 45 | ◎ | Absence |
| 13 | 0.09 | 480 | 10 | ○ | Absence |
| 14 | 0.10 | 460 | 30 | ◎ | Absence |
| 15 | 0.10 | 450 | 30 | ◎ | Absence |
| 16 | 0.11 | 460 | 45 | ◎ | Absence |
| 17 | 0.10 | 445 | 100 | ◎ | Absence |
| 18 | 0.10 | 500 | 15 | ○ | Absence |
| 19 | 0.08 | 490 | 3 | ◎ | Absence |
| 20 | 0.08 | 450 | 5 | ◎ | Absence |

Samples Nos. 10 to 20 in Table 4 were prepared in such a way as to meet the requirements of the present invention for the aluminum concentration in the plating bath and the plating bath temperature. They are superior in anti-powdering properties and they have the alloy zinc plating which is free of pure zinc layer.

By contrast, samples Nos. 5 and 6 prepared with a low aluminum concentration in the bath and sample No. 7 prepared with a high bath temperature are poor in anti-powdering properties although they are good in alloying state.

Also, samples Nos. 1 and 2 prepared with a high aluminum concentration in the bath and samples Nos. 3 and 4 prepared with a low bath temperature have residual pure zinc layer on the surface although they are superior in anti-powdering properties.

Samples Nos. 8 and 9 were prepared in such a way as to meet the requirements of the present invention for the aluminum concentration in the plating bath and the plating bath temperature. They are superior in anti-powdering properties but have residual pure zinc layer on the surface because of the short alloying time.

[Effect of the invention] The present invention as mentioned above provides a new steel sheet with alloy zinc coating which has good mechanical properties (such as total elongation) and good plating surface slidability, said steel sheet containing retained austenite and having a high silicon content.

What is claimed is:

1. A galvannealed steel sheet superior in workability and comprising a steel sheet plated with an alloy zinc plating, wherein the steel sheet is characterized by containing silicon in an amount no less than 0.8 mass % and retained austenite in an amount no less than 3% in terms of packing factor; and the alloy zinc plating is characterized by containing Zn—Fe alloy crystal grains which exist in its surface layer and have a specific crystal grain size such that the longer side of a crystal grain is no larger than twice the shorter side of the crystal grain and the number of crystal grains with an average particle size no smaller than 4 $\mu$m is no more than 5 per 70×50 $\mu$m.

2. A galvannealed steel sheet as defined in claim 1, which contains

Al: 0.01–0.4 mass %.

3. A galvannealed steel sheet as defined in claim 2, which further contains C: 0.06–0.6 mass %;

Mn: 0.5–3 mass %;

P: no more than 0.15 mass %, excluding 0 mass %; and

S: no more than 0.02 mass %, excluding 0 mass %.

4. A galvannealed steel sheet as defined in claim 2, which further contains at least one species selected from the group consisting of Mo: no more than 1 mass %, excluding 0 mass %;

Ni: no more than 0.5 mass %, excluding 0 mass %;

Cu: no more than 0.5 mass %, excluding 0 mass %; and

Cr: no more than 1 mass %, excluding 0 mass %.

5. A galvannealed steel sheet as defined in claim 2, which further contains at least one species selected from the group consisting of Ti: no more than 0.1 mass %, excluding 0 mass %;

Nb: no more than 0.1 mass %, excluding 0 mass %;

V: no more than 0.1 mass %, excluding 0 mass %.

6. A galvannealed steel sheet as defined in claim 2, which further contains, in terms of mass, Ca: no more than 30 ppm, excluding 0 ppm; and/or REM: no more than 30 ppm, excluding 0 ppm.

7. A method of making a galvannealed steel sheet, the method comprising plating a zinc alloy on a steel sheet; and producing the galannealed steel sheet of claim 1.

* * * * *

UNITED STATES PATENT AND TRADEMARK OFFICE

CERTIFICATE OF CORRECTION

PATENT NO. : 6,767,652 B2
DATED : July 27, 2004
INVENTOR(S) : Yamamoto et al.

It is certified that error appears in the above-identified patent and that said Letters Patent is hereby corrected as shown below:

Title page,
Item [73], Assignee, should read:

-- [73] Assignee: Kabushiki Kaisha Kobe Seiko Sho (Kobe Steel, Ltd.), Kobe (JP) --

Signed and Sealed this

Fourteenth Day of December, 2004

JON W. DUDAS
*Director of the United States Patent and Trademark Office*